US006892785B1

(12) United States Patent
Hung

(10) Patent No.: US 6,892,785 B1
(45) Date of Patent: May 17, 2005

(54) VERTICAL VENETIAN BLIND

(76) Inventor: Lai Chien Hung, P.O. Box 453, Taichung (TW)

( * ) Notice: Subject to any disclaimer, the term of this patent is extended or adjusted under 35 U.S.C. 154(b) by 42 days.

(21) Appl. No.: 10/629,555

(22) Filed: Jul. 30, 2003

(51) Int. Cl.[7] ..... E06B 9/30
(52) U.S. Cl. ..... 160/168.1 V; 160/173 V; 160/178.1 V
(58) Field of Search ..... 160/168.1 V, 168.1 R, 160/173 V, 173 R, 178.1 R, 178.1 V

(56) References Cited

U.S. PATENT DOCUMENTS 4,335,775 A * 6/1982 Frentzel et al. ..... 160/177 V
5,848,632 A * 12/1998 Chou ..... 160/168.1 V
5,894,877 A * 4/1999 Sommerfeld ..... 1/1
5,937,928 A * 8/1999 Chou ..... 160/900
5,975,187 A * 11/1999 Chou ..... 160/345
5,992,495 A * 11/1999 Cadorette ..... 160/168.1 V
6,334,477 B1 * 1/2002 Moir ..... 160/166.1 V
6,408,923 B1 * 6/2002 Nien ..... 160/168.1 V
6,585,025 B2 * 7/2003 Welfonder ..... 160/168.1 V
2004/0003902 A1 * 1/2004 Nien ..... 160/168.1 V

* cited by examiner

*Primary Examiner*—Bruce A. Lev
(74) *Attorney, Agent, or Firm*—Alan D. Kamrath; Nikolai & Mersereau, P.A.

(57) ABSTRACT

A vertical Venetian blind comprises a head rail, a first end cover, a second end cover, a control seat, a plurality of slat transmission seats, a plurality of link pieces, and a transmission shaft. The control seat, the slat transmission seats, the link pieces, and the transmission shaft are assembled together as a whole and can be therefore separate together from the head rail in the event that the head rail must be adjusted in length. The slat transmission seats can be easily adjusted in number. The transmission shaft can be adjusted in length accordingly.

1 Claim, 7 Drawing Sheets

VERTICAL VENETIAN BLIND

BACKGROUND OF THE INVENTION

1. Field of the Invention

The present invention relates to a vertical Venetian blind which can be easily reassembled.

2. Description of Related Art

The conventional vertical Venetian blind is generally ready-made and can not be reassembled to meet the requirements of a specific situation, due to the structural complexity of the conventional vertical Venetian blind.

SUMMARY OF THE INVENTION

The primary objective of the present invention is to provide a vertical Venetian blind which is relatively simple in construction and can be therefore reassembled easily to meet the requirements of a specific situation.

In keeping with the principle of the present invention, the foregoing objective of the present invention is attained by the vertical Venetian blind comprising a head rail, a control seat, a plurality of slat transmission seats, a plurality of link pieces, and a transmission shaft. The control seat, the slat transmission seats, the link pieces, and the transmission shaft are assembled together as a whole, so as to enable them to be separated together from the head rail in the event that the head rail must be adjusted in length. Upon completion of the length adjustment of the head rail, the separated unit is put back into the head rail. The number of the slat transmission seats can be also easily adjusted in accordance with the adjusted length of the head rail.

The features and the advantages of the present invention will be more readily understood upon a thoughtful deliberation of the following detailed description of the present invention with reference to the accompanying drawings.

DETAILED DESCRIPTION OF THE INVENTION

Figure 1:
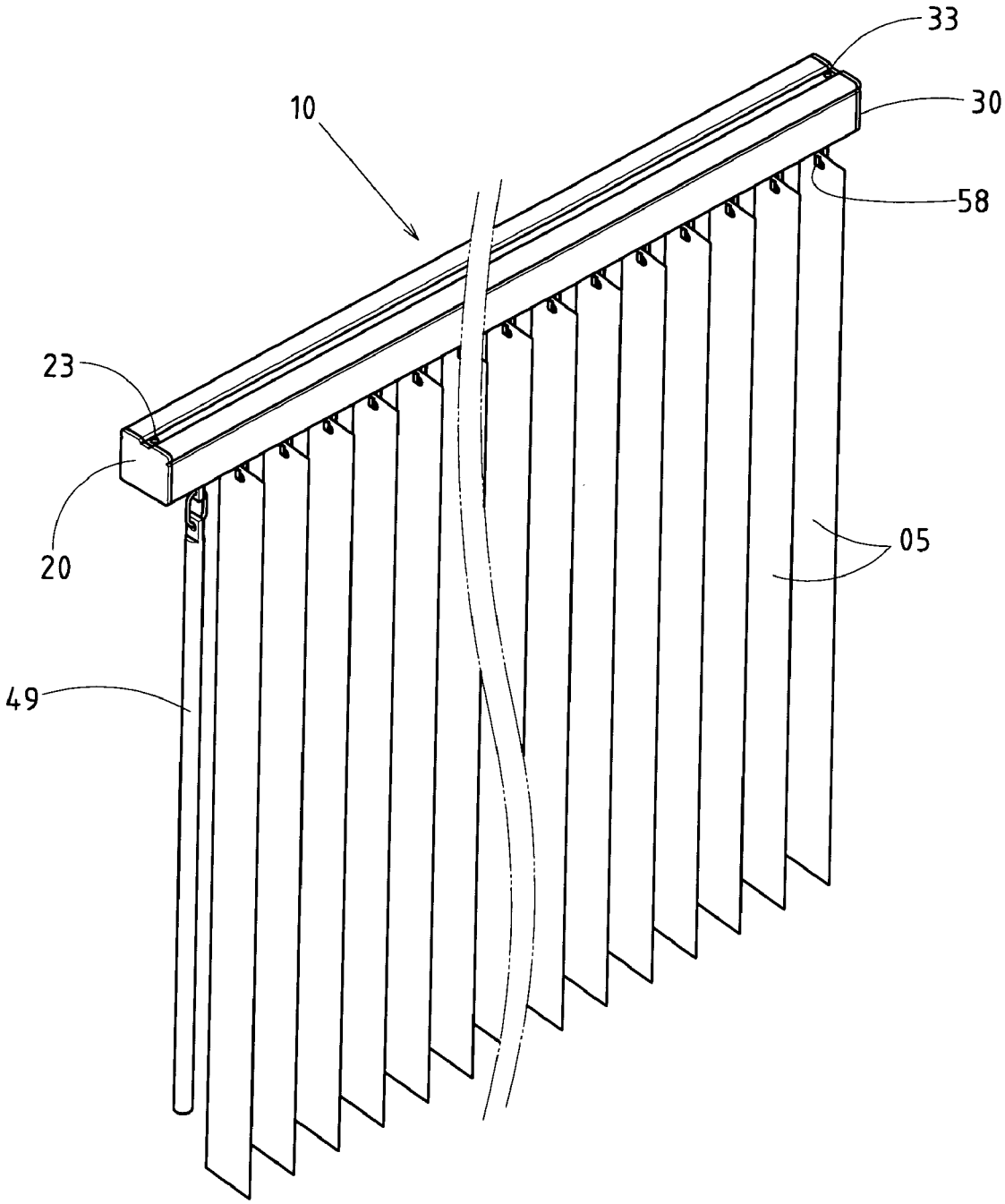
FIG. 1 shows a perspective view of the present invention.
Figure 2:
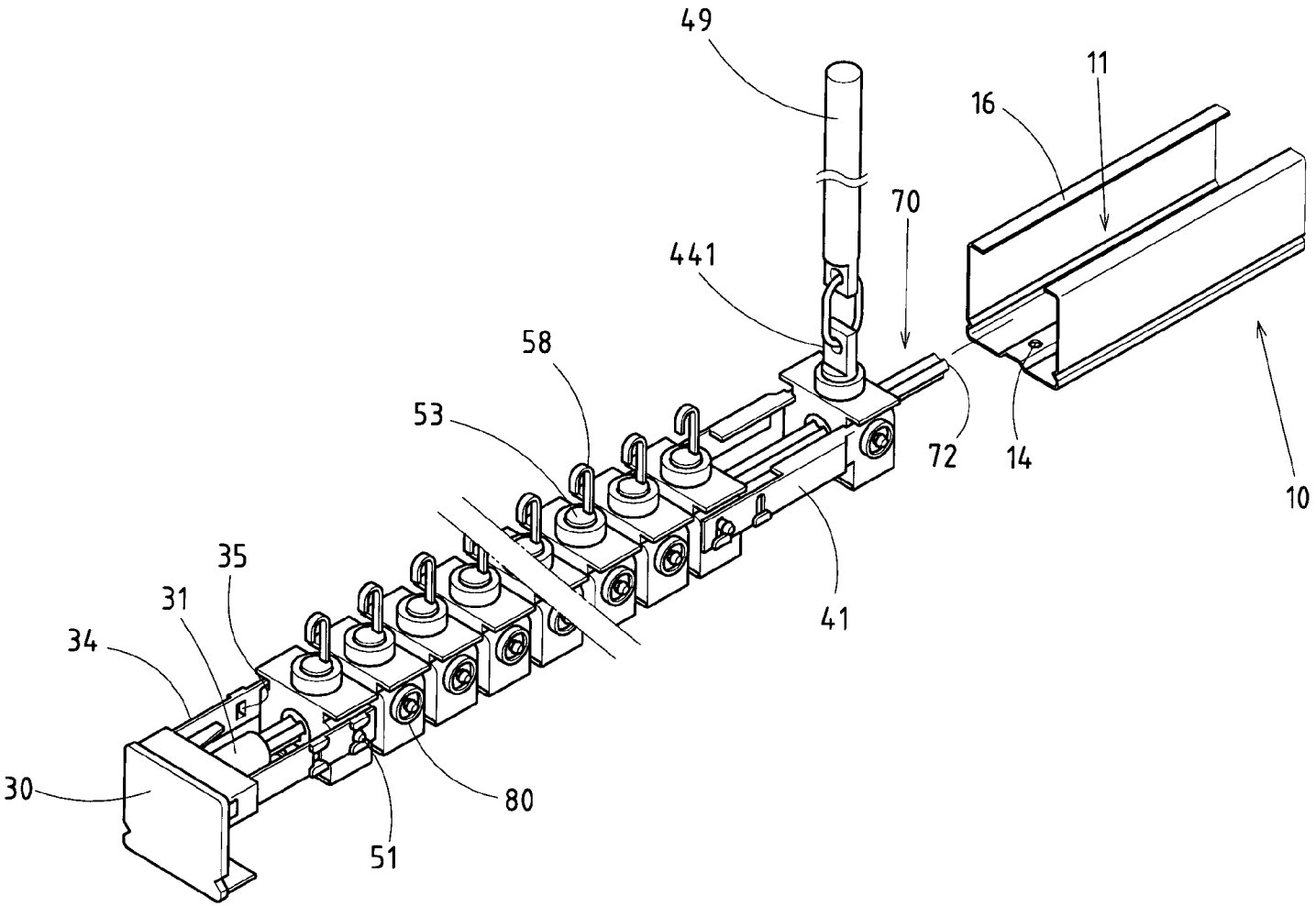
FIG. 2 shows a partial perspective view of the present invention.
Figure 3:
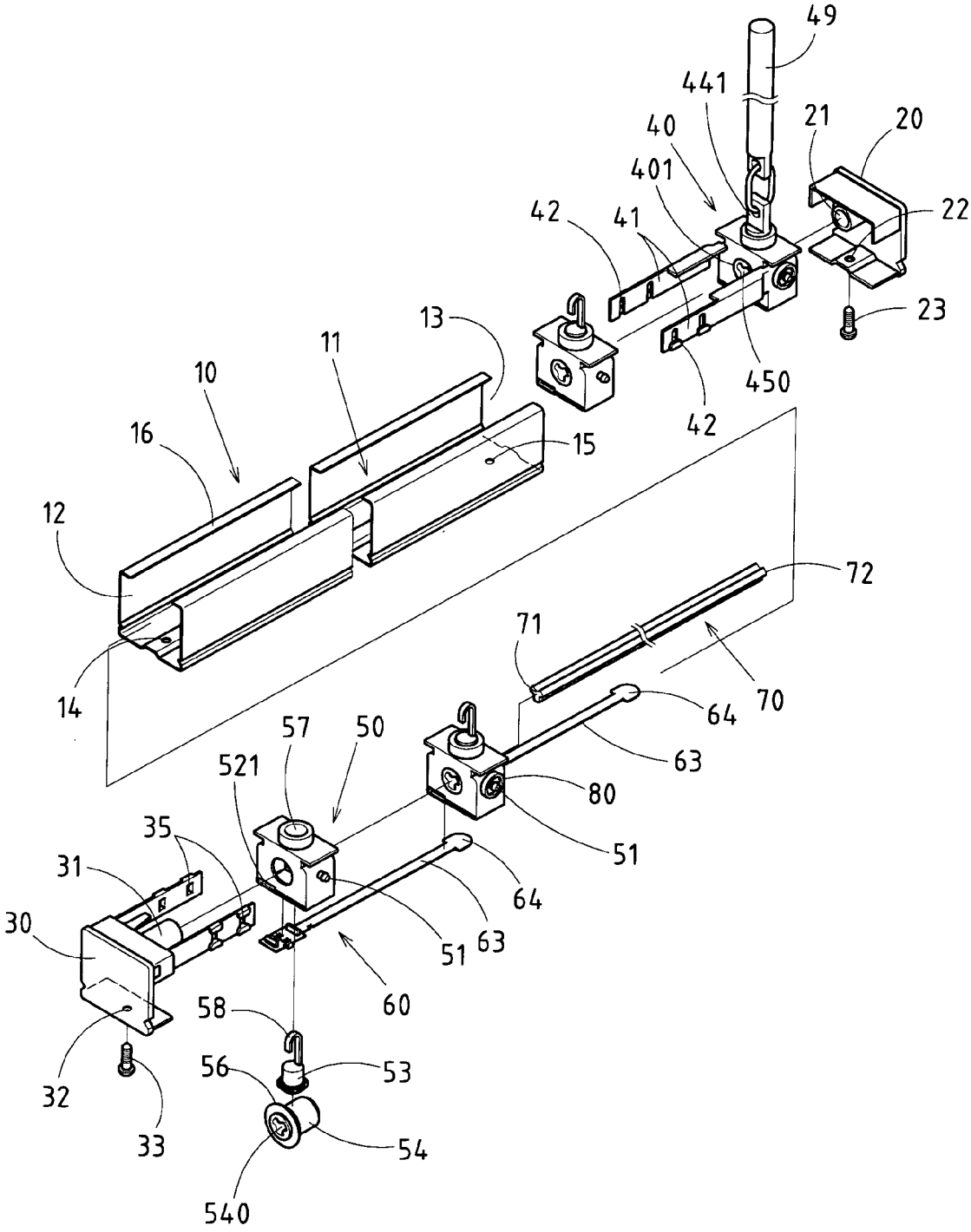
FIG. 3 shows an exploded view of the present invention.
Figure 4:
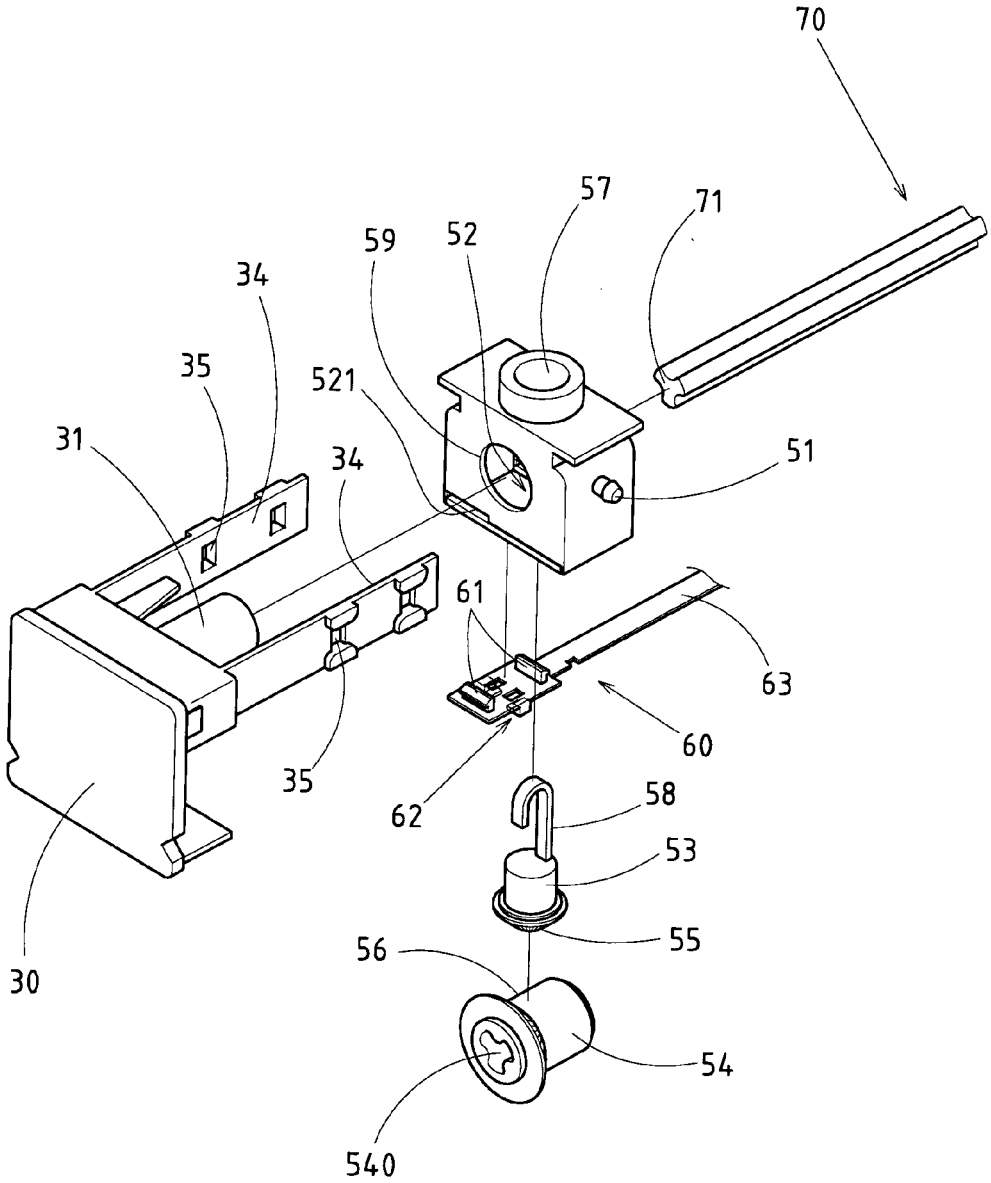
FIG. 4 shows a partial enlarged view of the present invention as shown in FIG. 3.
Figure 5:
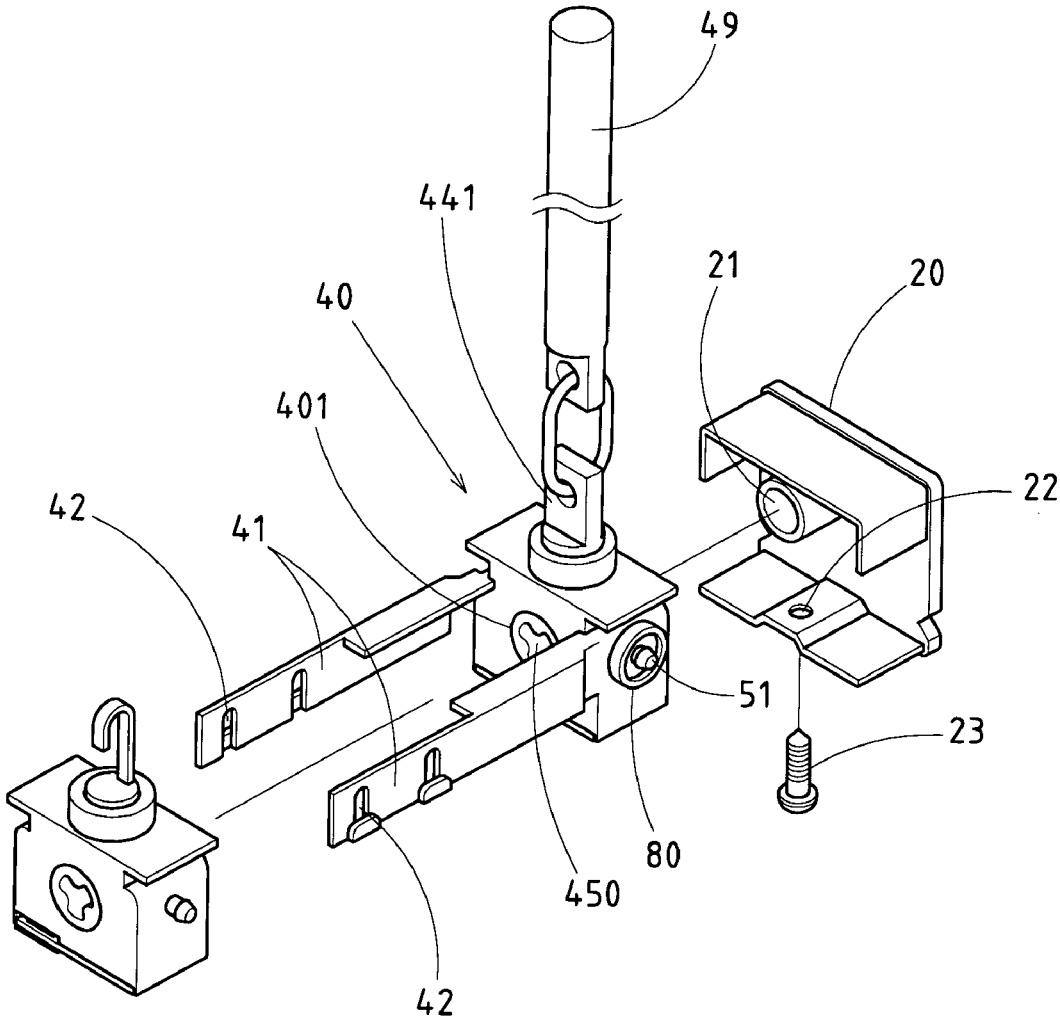
FIG. 5 shows another partial enlarged view of the present invention as shown in FIG. 3.

As shown in FIGS. 1–7, a vertical Venetian blind of the present invention comprises a head rail 10, a first end cover 20, a second end cover 30, a control seat 40, a plurality of slat transmission seats 50, a plurality of link pieces 60, and a transmission shaft 70.

The head rail 10 is integrally made by extrusion and is provided with a guide slot 11 extending along the longitudinal direction thereof. The guide slot 11 has two ends 12 and 13. The head rail 10 is provided with two through holes 14 and 15, and a side 16.

The first end cover 20 is joined with the one end 13 of the head rail 10 and is provided with a projection 21 and a threaded hole 22 corresponding in location to the through hole 15 of the head rail 10. The first end cover 20 is fastened to the head rail 10 by a bolt 23, which is engaged with the threaded hole 22 of the first end cover 20 via the through hole 15 of the head rail 10.

The second end cover 30 is provided with an insertion tube 31 extending therefrom, and a threaded hole 32 corresponding in location to the through hole 14 of the head rail 10. The second cover 30 is fastened with the head rail 10 by a bolt 33, which is engaged with the threaded hole 32 of the second end cover 30 via the through hole 14 of the head rail 10. The insertion tube 31 of the second end cover 30 is opposite to the projection 21 of the first end cover 20. The second end cover 30 is further provided with two protrusions 34, each having a retaining slot 35.

The control seat 40 is provided with two plates 41 extending therefrom in the same direction and having a plurality of retaining holes 42. The control seat 40 has a hollow interior 43 in which an upright pillar 44 and a cross pillar 45 are disposed. Located between the upright pillar 44 and the cross pillar 45 are two sector gears 46 and 47 which are engaged with each other. The upright pillar 44 has an outer end 441 extending through a through hole 48 of the control seat 40 to be connected with a control rod 49. The cross pillar 45 is pivoted at both ends with tow axial holes 401 of the control seat 40. The cross pillar 45 is provided in the center with a through hole 450.

The slat transmission seats 50 are provided with two retaining projections 51 opposite to each other, a hollow interior 52 in which an upright pillar 53, and a cross pillar 54 are disposed. Located between the upright pillar 53 and the cross pillar 54 are two sector gears 55 and 56 which are engaged with each other. The upright pillar 53 has an outer end, which is extended through a through hole 57 of the slat transmission seats 50 and is provided with a hooked portion 58 to catch a slat 05. The cross pillar 54 is pivoted at both ends with two axial holes 59 of the slat transmission seats 50. The cross pillar 54 is provided with a center through hole 540. The slat transmission seats 50 are provided with a retaining slot 521. The retaining projections 51 of one outermost slat transmission seat 50 are retained in the retaining slots 35 of the two protrusions 34 of the second end cover 30. The retaining projections 51 of other outermost slat transmission seat 50 are retained in the retaining holes 42 of the plates 41 of the control seat 40. The retaining projections 51 of the intermediate slat transmission seats 50 are provided with a roller 80.

The link pieces 60 are provided at one end with a retaining hook 61 and a through slot 62. The retaining hook 61 is retained in the retaining slot 521 of the slat transmission seats 50. The link pieces 60 are provided with an extension end 63 having a stop edge 64. The extension end 63 is put through the through slot 62 of an adjoining link piece 60. When two adjoining slat transmission seats 50 are pulled apart for a distance, the stop edge 64 is stopped at the through slot 62 of the link piece 60 of another slat transmission seat 50. As the frontmost slat transmission seat 50 is actuated, other slat transmission seats 50 are actuated accordingly.

The transmission shaft 70 has a first end 71 and a second end 72. The first end 71 is inserted into the insertion tube 31 of the second end cover 30. The second end 72 is pivoted with the projection 21 of the first end cover 20 via the center through holes 540 of the cross pillars 54 of the slat transmission seats 50, and the center through hole 450 of the cross pillar 45 of the control seat 40.

Figure 6:
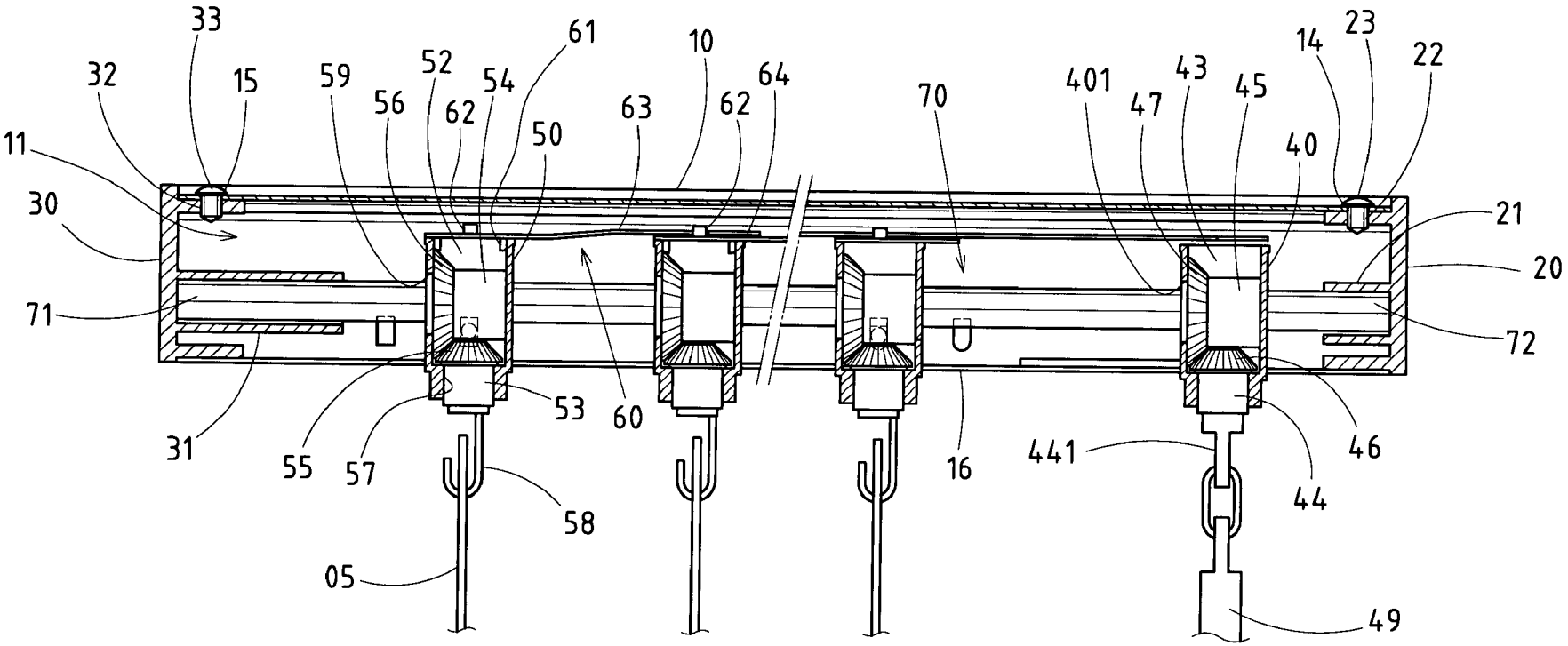
FIG. 6 shows a sectional schematic view of the present invention in combination.

As illustrated in FIG. 6, when the control rod 47 of the control seat 40 is turned, the upright pillar 44 of the control seat 40 is driven to turn, with the motion being transmitted to the cross pillar 45 via the two sector gears 46 and 47 of the control seat 40, thereby resulting in an actuation of the transmission shaft 70. As a result, the upright pillars 53 of the slat transmission seats 50 turn in the same direction. The slats 05 are actuated accordingly.

Figure 7:
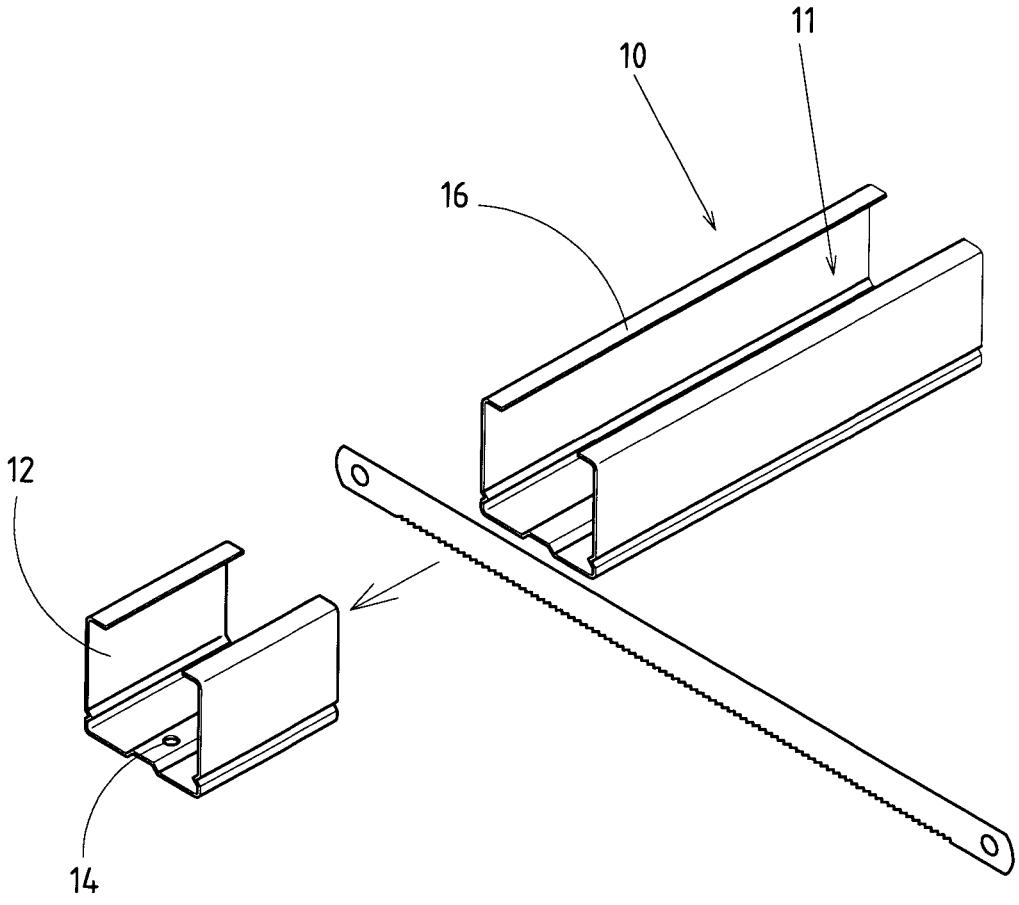
FIG. 7 shows a schematic view of the length adjustment of the head rail of the present invention.

In light of the fact that the slat transmission seats 50 and the link pieces 60 are detachably fastened together, and that the control seat 40 and the slat transmission seat 50 are detachably fastened together, and that the slat transmission seat 50 and the second end cover 30 are detachably fastened together, the second end cover 30 can be removed along with the slat transmission seats, the control seat 40, the link pieces 60, and the transmission shaft 70 by unfastening the bolts 23 and 33 of the first end cover 20 and the second end cover 30. In the event that the head rail 10 must be adjusted in length, the adjustment can be easily done, as illustrated in FIG. 7. The transmission shaft 70 must be also adjusted in length accordingly. In addition, the slat transmission seats 50 can be adjusted in number.

I claim:

1. A vertical Venetian blind comprising:

a head rail of a length;

a first end cover detachably fastened with one end of said head rail and provided with a projection;

a second end cover detachably fastened with other end of said head rail and provided with an insertion tube extending therefrom, and two protrusions, each having a retaining slot;

a control seat provided with a hollow interior, an upright pillar located in said hollow interior, a cross pillar located in said hollow interior, and two sector gears located in said hollow interior such that said two sector gears are engaged with each other and are located between said upright pillar and said cross pillar, said control seat further provided with two plates extending therefrom in the same direction and having a plurality of retaining holes, a control rod fastened with an outer end of said upright pillar, and two axial holes engaging two ends of said cross pillar whereby said cross pillar is provided with a center through hole;

a plurality of slat transmission seats, each being provided with two retaining projections opposite to each other, a hollow interior, an upright pillar disposed in said hollow interior, a cross pillar disposed in said hollow interior, two sector gears disposed in said hollow interior such that said two sector gears are engaged with each other and located between said upright pillar and said cross pillar, said upright pillar provided with a hooked portion to catch a slat, said cross pillar provided with a center through hole and engaged at two ends thereof with two axial holes of said slat transmission seats, said slat transmission seats further provided with a retaining slot whereby said slat transmission seats are serially and movably disposed in said head rail in such a manner that said retaining projections of one outermost slat transmission seat are retained in said retaining slots of said protrusions of said second end cover, and that said retaining projections of other outermost slat transmission seat are retained in said retaining holes of said two plates of said control seat, and that said retaining projections of intermediate slat transmission seats are provided with a roller;

a plurality of link pieces, each being provided at one end with a retaining hook and a through slot, with said retaining hook being retained in said retaining slot of one of said slat transmission seats, said link pieces further provided with an extension end having a stop edge, said link pieces being serially arranged in such a way that said extension end is put through said through slot of an adjoining link piece, and that said stop edge is stopped at said through slot of one of said link piece at such time when two adjoining slat transmission seats are pulled apart for a distance; and a transmission shaft having a first end and a second end, with said first end being inserted into said insertion tube of said second end cover, with said second end being pivoted with said projection of said first end cover via said center through hole of said cross pillar of each of said slat transmission seats, and said center through hole of said cross pillar of said control seat.

* * * * *